US005678659A

United States Patent [19]

Vetter et al.

[11] Patent Number: 5,678,659

[45] Date of Patent: Oct. 21, 1997

[54] ORDER PICKING TRUCK WITH AN INITIAL LIFT DEVICE

[75] Inventors: Klaus Vetter, Reutlingen; Kurt Walter, Sonnenbühl, both of Germany

[73] Assignee: Wagner Fordertechnik GmbH & Co. KG, Germany

[21] Appl. No.: 560,021

[22] Filed: Nov. 17, 1995

[30] Foreign Application Priority Data

Nov. 17, 1994 [DE] Germany ..... 44 40 990.7

[51] Int. Cl.[6] ..... B66F 9/22

[52] U.S. Cl. ..... 187/234; 187/269

[58] Field of Search ..... 187/231, 234, 187/233, 222, 269; 414/630, 631

[56] References Cited

U.S. PATENT DOCUMENTS 3,062,325 11/1962 Quayle ..... 187/234
4,543,031 9/1985 Luebrecht ..... 414/631

FOREIGN PATENT DOCUMENTS 1417126 12/1975 United Kingdom .
1520990 8/1978 United Kingdom .

*Primary Examiner*—Kenneth Noland
*Attorney, Agent, or Firm*—Thomas R. Shaffer, Esq.

[57] ABSTRACT

An order picking truck, in particular a high-lift order picking truck, is equipped with a driver's stand (3), a load-picking fork (5) and a wall (11) separating the driver's stand (3) from the load area. The fork (5) is secured on an initial lift device (7, 8, 9, 10) so that it can be moved up and down relative to the driver's stand (3). According to the invention, an additional lift device (17, 18, 20) is provided with which a load on the fork can be raised beyond the highest position of the initial lift device. The fork has two-part fork tines (12, 13) which each have a load picking upper part (13) and a lower part (12) secured to the initial lift device. Each two-part fork tine includes a scissor construction (19) guiding the upper part (13) of the tine parallel with the lower part (12) of the tine.

9 Claims, 5 Drawing Sheets

ORDER PICKING TRUCK WITH AN INITIAL LIFT DEVICE

BACKGROUND OF THE INVENTION

1. Field of the Invention

The present invention relates to lift trucks, and particularly concerns a high-lift order picking truck with a driver's stand, a load picking fork and a wall separating the driver's stand from the load area, the fork being secured to an initial lift device so that it can be moved up and down relative to the driver's stand.

2. Description of the Prior Art

Order picking trucks are used to move goods of different kinds and quantities out of or into different storage locations. The objects are moved in or out by hand. High-lift order picking trucks have a lifting framework on which a driver's stand can be moved up and down, together with a load picking device. Storage locations on high shelves can thus be reached with the operator raised to the height of the shelf to observe and control the picking operation. The driver's stand is separated from the load picking device and the loads thereon by a wall. As a rule, the load picking device comprises a fork with which pallets for example can be picked up very easily. The fork is provided with a stop plate to prevent pallets striking the wall. On order picking trucks the two fork tines and the stop plate are usually made in one part.

With an initial lift device the fork can be moved up and down relative to the driver's stand. The initial lift device has its own hydraulic cylinder which moves the stop plate with the fork along vertical guide rails. The highest position of the initial lift device is predetermined by the height of the wall since the guide rails of the initial lift device do not generally project above the upper edge of the wall. This and the height of the stop plate determine the highest position of the tines of the fork in relation to the driver's stand.

At the highest position of the initial lift device the upper side of a pallet lies significantly below the upper edge of the wall. When manipulating heavy loads, this requires the driver to adopt an ergonomically unfavorable body attitude.

SUMMARY OF THE INVENTION

The underlying object of the present invention is to provide an order picking truck which allows ergonomically favorable handling of loads.

Lifting the load beyond the highest position of the initial lift device makes its handling much easier. This brings the upper side of the pallet to a favorable working height for the driver, and in addition the load is now roughly at the height of the upper edge of the wall. In order to reach the load, the driver no longer needs to reach down over the wall. These ergonomic improvements also lead to a reduction in the time of the individual order picking operations.

One advantageous embodiment of the invention is characterized in that the fork has two-part fork tines, in each case the fork tine consisting of a load picking upper part and a lower part secured to the initial lift device. When the fork tines are embodied in two halves, the lower parts together with the stop plate can be secured to the initial lift device in a conventional manner. When the additional lift device is switched off, the two tine parts are brought together so that their common height allows problem-free extension into the pallets normally employed. When the additional lift device is operated, the upper parts of the tines with the load thereon are lifted away from the lower parts of the tines. To lift very wide loads, forks with more than two tines can be used. When an additional lift device is used in conjunction with such forks, it is possible that not all, but at least two of the fork tines are constructed in two vertically separable parts.

Expediently the additional lift device comprises at least one hydraulic additional lift cylinder which is disposed preferably adjacent the wall, and serves to selectively lift the load-supporting upper parts of the tines. In order to keep the space under the fork free, the additional lift cylinder is disposed in the area of the wall. This arrangement only requires a small additional outlay for the hydraulic fluid supply to the additional lift cylinder, as the cylinder of the initial lift device is already located in this area and its supply lines can be tapped to provide a valved source of hydraulic fluid to the additional lift cylinder.

In a particularly advantageous embodiment, each two-part fork tine includes a scissor construction to lift the upper part of the tine while maintaining it horizontal and parallel with the lower part of the tine. The scissor construction guarantees guidance of the upper part of the tine parallel with the lower part of the tine, regardless of the position of the additional lift cylinder. When the additional lift device is switched off, the scissor construction is located in the free space between the two tine parts without increasing their common unit height. Each of the two-part fork tines is preferably provided with its own scissor mechanism.

In a particularly advantageous embodiment, the additional lift device includes at least one transmission means which links the additional lift cylinder to the scissor mechanisms which raise the upper parts of the tines. When the additional lift cylinder is extended, the upper parts of each of the two-part the tines are raised by the transmission means.

Advantageously the transmission means is secured to the additional lift cylinder so that it can be moved from an active position into a passing position and vice versa, and in the active position the upper part of the tine can be lifted by the transmission means and in the passing position the transmission means can be moved past the upper part of the tine. During the initial lift the upper part of the tine can be moved past the retracted additional lift cylinder with the transmission means fixed thereto. The transmission means is in the passing position. The transmission means has to be brought to the active position in order to be able to lift the upper part of the tine with the additional lift cylinder. The upper part of the tine can be lifted by the additional lift cylinder with the aid of the transmission means.

In one particularly simple embodiment the transmission means is embodied as an transmission plate essentially pivotable about a vertical axis. By rotation through a certain angle the transmission plate can be brought from the active position into the passing position and vice versa.

Advantageously the transmission plate is rotatable by means of a turning device according to the position of the additional lift cylinder. During the initial lift the transmission plate is in the passing position so that no collision can occur between the transmission means and the upper part of the tine. In the highest position of the initial lift device the transmission plate is located under the upper part of the tine. If the additional lift cylinder is now extended, firstly, during the first part of the movement of the cylinder, the transmission plate is rotated into the active position in order to be able to lift the upper part of the tine. Likewise, when the additional lift cylinder is retracted, the transmission plate is rotated back again shortly before reaching the lowest position.

In a particularly simple embodiment, the turning device has at least one essentially vertical guide bar which cannot move relative to the wall and determines the position of the rotatable transmission plate, the guide bar having an appropriate curvature at the height intended for rotation of the transmission plate. The position of the transmission plate is determined by the guide bar. When the additional lift cylinder moves, the transmission plate follows the curvature of the guide bar and is thus turned at the appropriate time.

BRIEF DESCRIPTION OF THE DRAWING

Further advantages and features of the present invention will now be explained in greater detail with reference to the exemplary embodiment illustrated in the accompanying diagrammatic Figures, in which:

DETAILED DESCRIPTION OF THE PREFERRED EMBODIMENT

Figure 1:
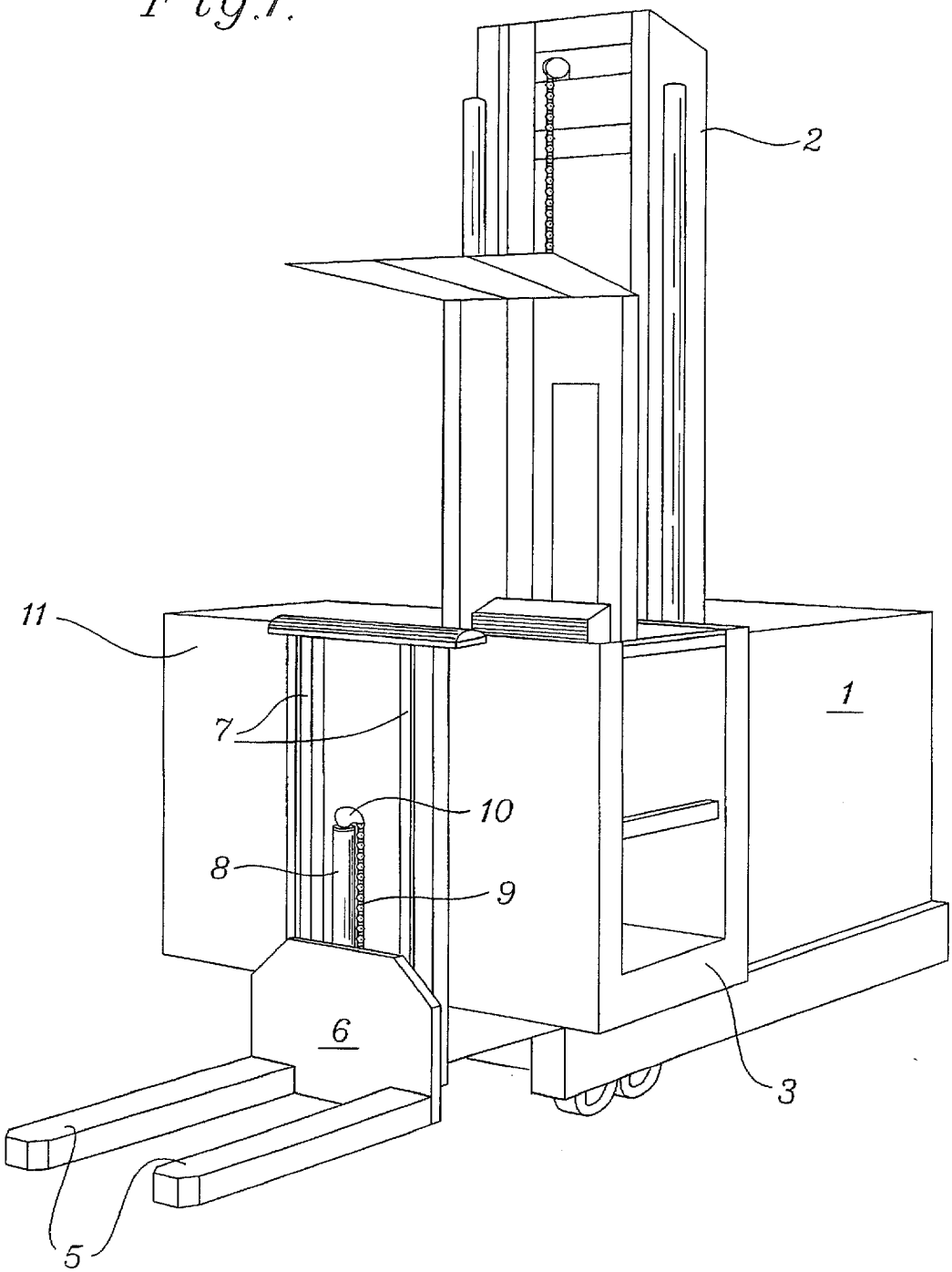
Figure 2:
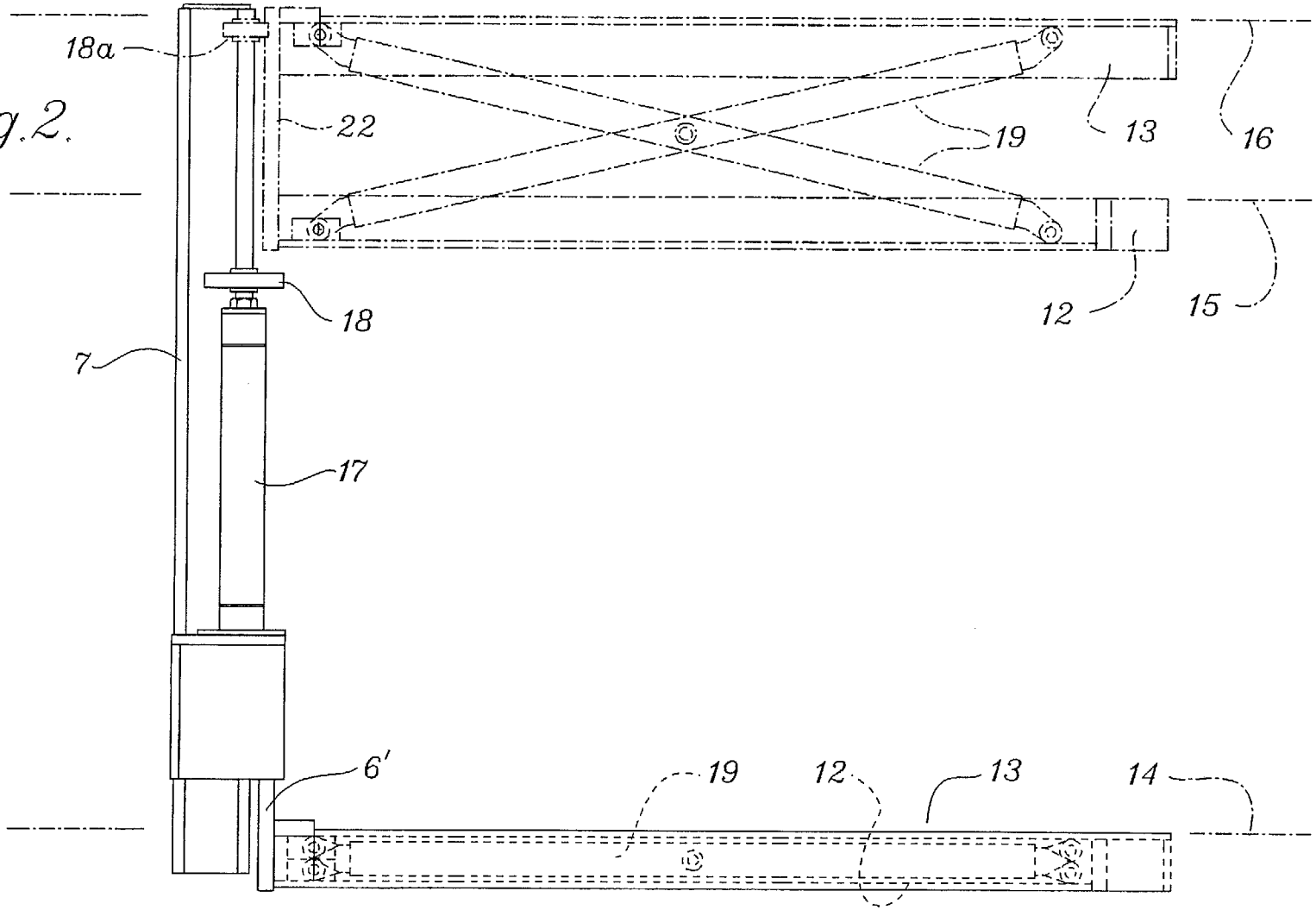
Figure 3:
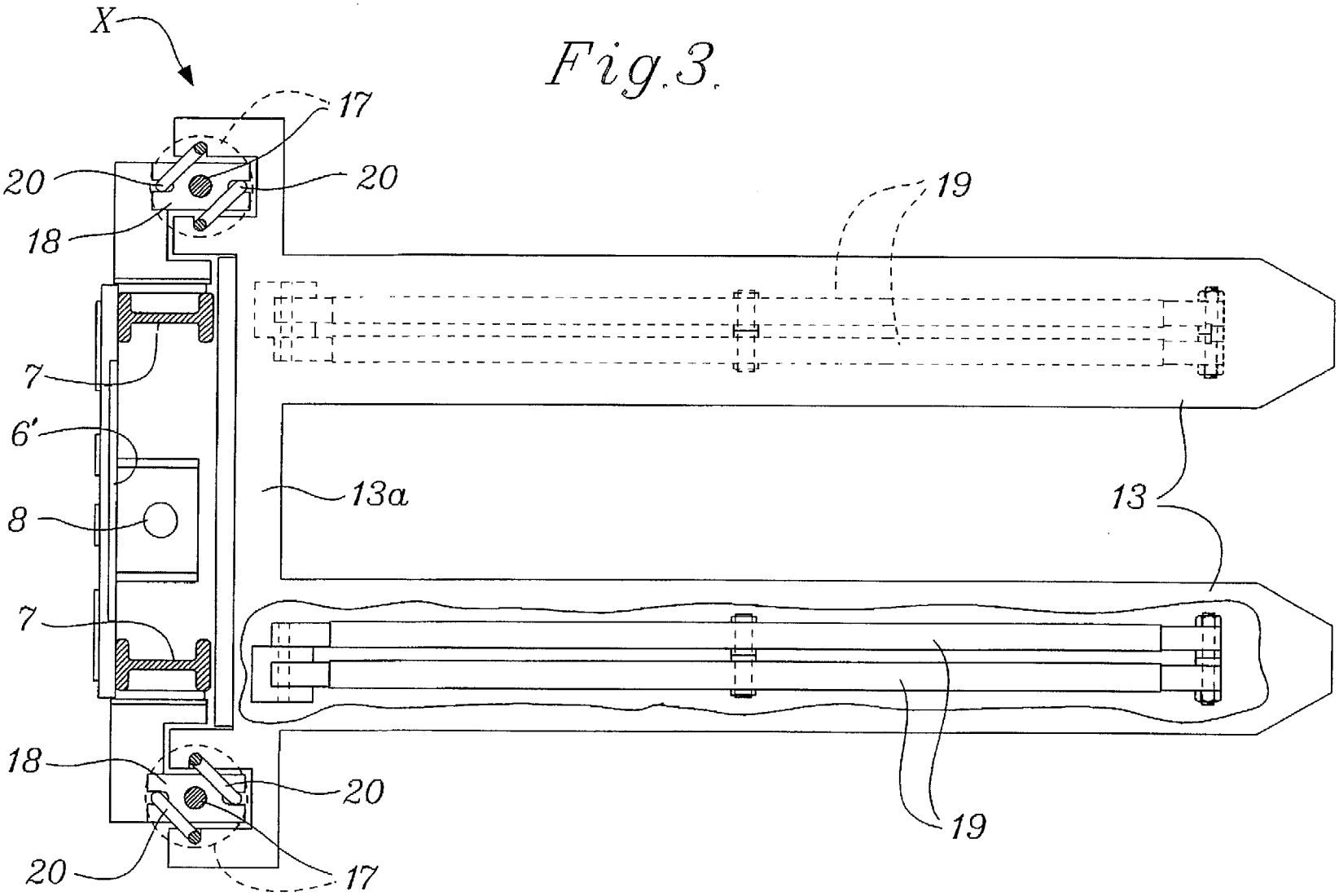
Figure 4:
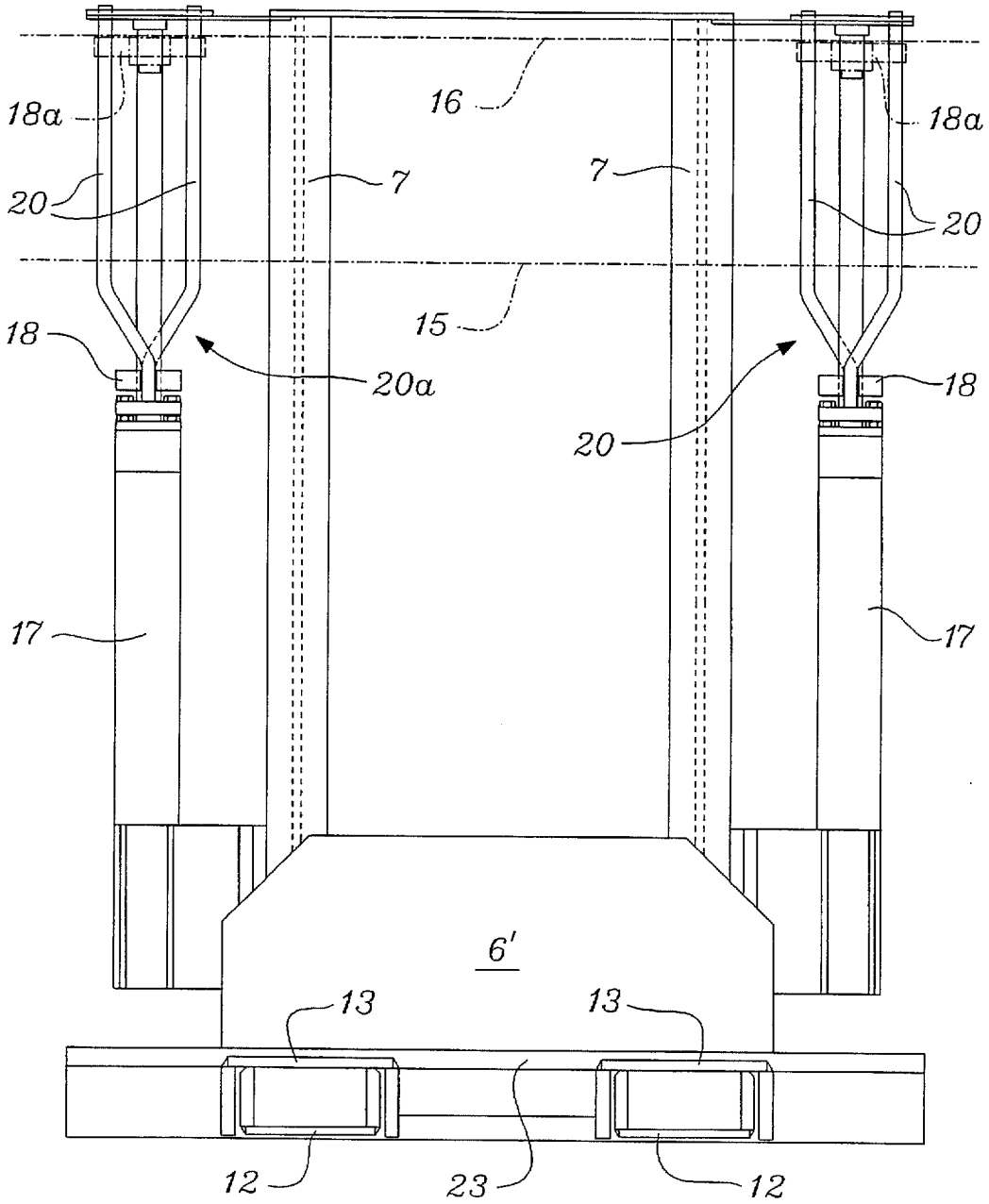
Figure 5:
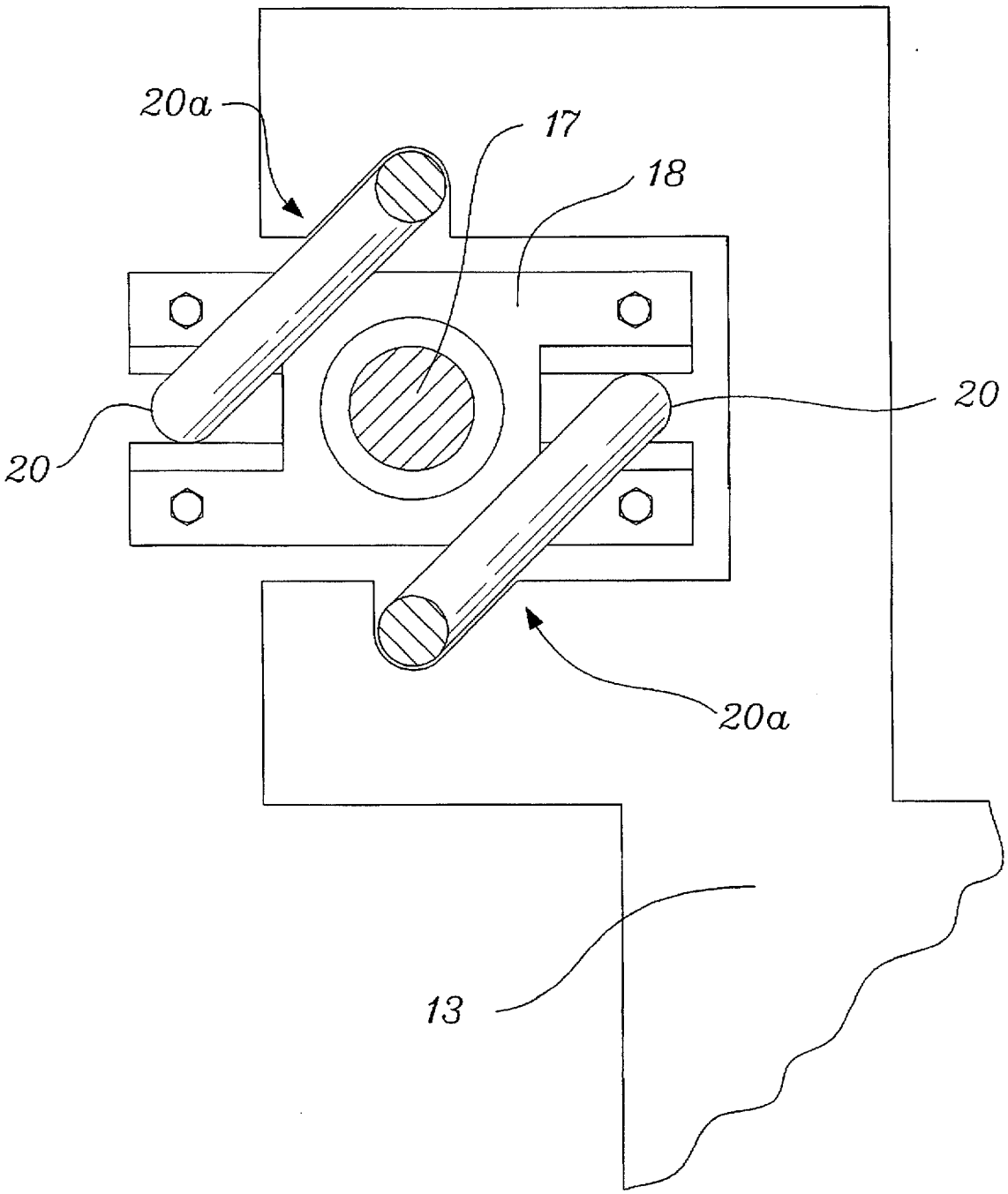

FIG. 1 shows a high-lift order picking truck of the type described according to the state of the art;

FIG. 2 shows the load part of an order picking truck according to the invention in a side view;

FIG. 3 shows the load part of an order picking truck according to the invention in a plan view;

FIG. 4 shows the load part of an order picking truck according to the invention in a front view; and FIG. 5 shows an transmission plate according to the invention.

FIG. 1 shows a conventional high-lift order picking truck. A housing 1, which encloses batteries and drive assemblies, is located in the rear area of the body of the high-lift order picking truck. A lifting mast 2 is disposed in front of the housing 1. The driver's stand 3 is fixed so that it can be moved up and down on the lifting mast 2. An initial lift device with fork tines is secured to the driver's stand 3 so that the tines can be moved up and down relative thereto. The fork is formed by two fork tines 5 which are joined securely to a stop plate 6. The initial lift device essentially consists of two guide rails 7, an initial lift cylinder 8, a drive-transmitting chain 9 and a guide sprocket 10. On the load side the driver's stand is bounded by a wall 11. With the initial lift device the fork can be moved upwards relative to the driver's stand, out of the position shown. The highest position of the fork is determined by the height of the stop plate 6 and the length of the fork guide disposed behind it in the guide rail 7. Thus, in the highest position of the initial lift device the fork tines are approximately 20 cm below the wall.

FIG. 2 shows the load part of an order picking truck according to the present invention, in side view. The fork with the two-part fork tines according to the invention is secured to the guide rails 7 of the initial lift device. The lower parts 12 of the tines can be lifted by the initial lift device (not shown). To move loads within the lifting range of the initial lift device, the upper parts 13 of the tines rest on the lower parts 12 of the tines. The stop plate 6' is secured to the lower parts 12 of the tines. A load can be raised from the lower load plane 14 to the upper initial lift plane 15 with the initial lift device.

Starting from the upper initial lift plane 15, the upper parts of the tines can be lifted to the additional lift plane 16 with the additional lift device according to the invention. The upper parts of the tines are lifted by two additional lift cylinders 17 with the transmission plates 18 fixed pivotably thereto. The highest position of the transmission plates 18, with the transmission plates 18 turned to the active position 18*a*, is also shown. The upper parts 13 of the tines are guided parallel with the lower parts 12 of the tines by the scissor mechanisms constituted by the arms 19. In the lifting range of the initial lift device, i.e., between the lower load plane 14 and the initial lift plane 15, the scissor mechanisms 19 are located in a free space between the upper and lower parts of the fork tines lying on one another.

FIG. 3 shows the load part of an order picking truck according to the present invention in plan view. The fork tines are shown located in a position within the area of the initial lift, between the lower load plane 14 and the initial lift plane 15 (FIG. 2). The two upper parts 13 of the tines are joined securely together by means of a crosspiece 13*a*, the ends of which extend laterally into the area above the additional lift cylinders 17. Naturally, it is also possible to make the upper parts of the tines separate from one another. The upper parts 13 of the tines lie on the lower parts of the tines.

Each of the additional lift cylinders 17 has a generally rectangular transmission plate 18 secured to the end of its piston rod, the transmission plates 18 being rotatable about the cylinder axis. Cutouts in the end regions of the crosspiece 13*a* are so dimensioned that the transmission plates 18 can pass through the cutouts when in a first, passing, position, but cannot pass through the cutouts when they have been rotated by 90° from the passing position into a second, active position.

The transmission plates 18 are rotated between the active and the passing position by guide bars 20 which are secured to the cylinder housings of the additional lift cylinders 17. The arrangement of the guide bars 20 is such that the transmission plates 18 are held in the passing position while the additional lift cylinders 17 are retracted, and are rotated into their active position as the additional lift cylinders 17 are initially extended, so that, with the crosspiece 13*a* in the initial lift plane 15, the transmission plates 18 have reached the active position before they contact the underside of the crosspiece 13*a*.

Clearly, with the additional lifting cylinders retracted, the crosspiece 13*a* and the upper parts 13 of the tines can be moved past the transmission plates 18 without colliding. The initial lift cylinder 8 is also shown.

FIG. 4 shows the load part of an order picking truck according to the invention in a front view. The fork tines consisting in each case of the upper part 13 of the tine and the lower part 12 of the tine are located in their lowest position. With the initial lift device the fork can be lifted, guided on the guide rails 7, to the upper initial lift plane 15. If the additional lift cylinders 17 are then extended, the transmission plates 18 initially pass through the curved area 20*a* of the guide bars 20, each guide bar having a curved portion 20*a* following a substantially helical path, and in the process are turned through 90° from the passing position into the active position. Then the transmission plates 18 meet the underside of the crosspiece 13*a*, or alternatively may directly contact the undersides of the upper parts 13 of the tines, which can be lifted at most to the additional lift plane 16.

The detail marked X in FIG. 3 is shown enlarged in FIG. 5, which is a view from above of the guide bars 20 with the crosspiece 13*a* situated below the transmission plates 18. The transmission plate 18 is in the passing position so that the crosspiece 13*a* and the upper parts 13 of the tines can be moved past the transmission plate. The position of the transmission plate 18 is determined by the guide bars 20, which engage in respective slots formed in the ends of the transmission plate 18. To rotate the transmission plate 18, the curved area 20*a* of the guide bars acts against the side of the slot as a cam to urge the transmission plate 18 to rotate. It will be understood that although two guide bars 20 are shown, it is foreseen that a single guide bar, or other cam mechanism, may be provided to rotate each transmission plate.

While certain presently preferred embodiments of the present invention have been described and illustrated, it is to be distinctly understood that the invention is not limited thereto but may be otherwise embodied and practiced within the scope of the following claims.

We claim:

1. An order picking truck, having a driver's stand (3), a load picking fork and a wall (11) separating the driver's stand from the load area, said wall having an upper edge, the fork being secured so that it can be moved up and down relative to the driver's stand on an initial lift device, wherein an additional lift device is provided in connection with the fork with which a load on the fork can be lifted beyond the highest position of the initial lift device to the level of the upper edge of the wall (11).

2. An order picking truck according to claim 1, wherein the fork has at least one two-part fork tine, with each two-part fork tine having a load picking upper part (13) and a lower part (12) secured to the initial lift device.

3. An order picking truck according to claim 2, wherein the additional lift device has at least one hydraulic additional lift cylinder (17) which lifts the upper parts (13) of the tines and is disposed in the area of the wall (11).

4. An order picking truck, having a driver's stand (3), a load picking fork and a wall (11) separating the driver's stand from the load area, the fork being secured so that it can be moved up and down relative to the driver's stand on an initial lift device, wherein an additional lift device is provided with which a load on the fork can be lifted beyond the highest position of the initial lift device, wherein the fork has at least one two-part fork tine, with each two-part fork tine having a load picking upper part (13) and a lower part (12) secured to the initial lift device wherein each two-part fork tine has a scissor construction (19) guiding the upper part (13) of the tine parallel with the lower part (12) of the tine.

5. An order picking truck, having a driver's stand (3), a load picking fork and a wall (11) separating the driver's stand from the load area, the fork being secured so that it can be moved up and down relative to the driver's stand on an initial lift device, wherein an additional lift device is provided with which a load on the fork can be lifted beyond the highest position of the initial lift device, wherein the fork has at least one two-part fork tine, with each two-part fork tine having a load picking upper part (13) and a lower part (12) secured to the initial lift device, wherein the additional lift device has at least one hydraulic additional lift cylinder (17) which lifts the upper parts (13) of the tines and is disposed in the area of the wall (11), and wherein the additional lift device has at least one transmission means secured to the additional lift cylinder (17) and lifting the upper parts (13) of the tines.

6. An order picking truck according to claim 5, wherein the transmission means is secured to the additional lift cylinder (17) so that it can be moved from an active position into a passing position and vice versa, and in the active position the upper part (13) of the tine can be lifted by the transmission means and in the passing position the transmission means can be moved past the upper part (13) of the tine.

7. An order picking truck according to claim 6, wherein the transmission means is embodied as an transmission plate (18) essentially pivotable about a vertical axis.

8. An order picking truck according to claim 7, wherein the transmission plate (18) is rotatable by means of a turning device which alters the angular position of the transmission plate (18) according to the axial position of the piston of the additional lift cylinder (17).

9. An order picking truck according to claim 8, wherein the turning device has at least one essentially vertical guide bar (17) which cannot move relative to the wall (11) and determines the position of the rotatable transmission plate (18), the guide bar having a curved portion following a substantially helical path at the height intended for rotation of the transmission plate.

* * * * *